US005628865A

United States Patent [19]

Marschke

[11] Patent Number: 5,628,865

[45] Date of Patent: May 13, 1997

[54] SINGLE FACER WITH SMALL INTERMEDIATE CORRUGATING ROLL

[75] Inventor: Carl R. Marschke, Phillips, Wis.

[73] Assignee: Marquip, Inc., Phillips, Wis.

[21] Appl. No.: 621,998

[22] Filed: Mar. 26, 1996

[51] Int. Cl.[6] ..... B31F 1/26; B31F 1/28

[52] U.S. Cl. ..... 156/473; 156/205; 156/472; 156/210; 493/463

[58] Field of Search ..... 156/205, 210, 156/471–473, 553, 209, 582; 264/286; 425/369, 336; 493/463

[56] References Cited

U.S. PATENT DOCUMENTS

| | | | |
|---|---|---|---|
| 1,264,506 | 4/1918 | Hahn | 156/473 |
| 1,960,677 | 5/1934 | List | 425/369 |
| 2,429,482 | 10/1947 | Munters | 264/286 |
| 2,589,966 | 3/1952 | Rullo | 156/472 |
| 3,630,806 | 12/1971 | Kitajima | 156/472 |
| 3,990,935 | 11/1976 | Lehmann | 156/472 |
| 4,531,996 | 7/1985 | Sukenik | 156/472 |
| 5,419,796 | 5/1995 | Miller | 156/472 |

*Primary Examiner*—Michele K. Yoder
*Attorney, Agent, or Firm*—Andrus, Sceales, Starke & Sawall

[57] ABSTRACT

The labyrinth path in the corrugating nip of a single facer is substantially reduced by utilizing a small diameter intermediate corrugating roll captured between a pair of larger diameter conventional corrugating rolls. The two large diameter rolls capture the smaller roll and prevent bending thereof under corrugating loads. The corrugator may be operated at high speeds without the adverse increase in labyrinth path and web tension characteristic of large diameter corrugating rolls.

7 Claims, 1 Drawing Sheet

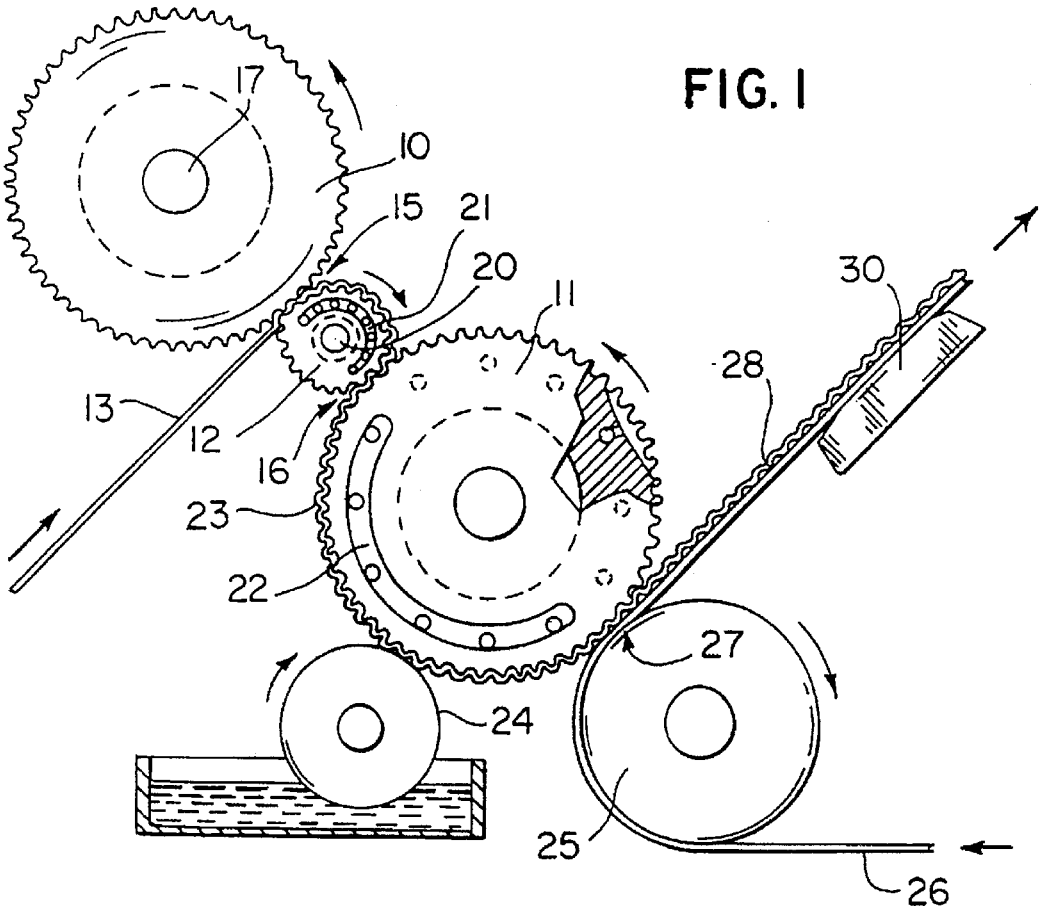
FIG. 1
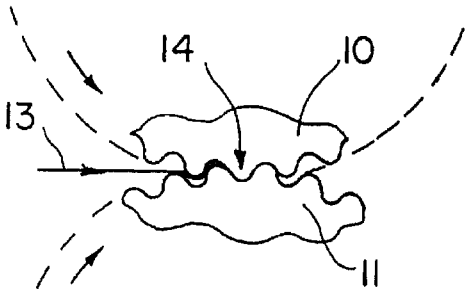
FIG. 2
PRIOR ART
FIG. 3
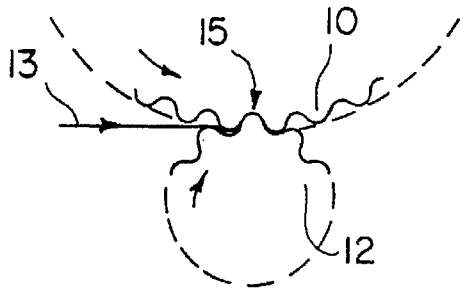

SINGLE FACER WITH SMALL INTERMEDIATE CORRUGATING ROLL

BACKGROUND OF THE INVENTION

The present invention pertains to an apparatus for forming a single face web of corrugated paperboard and, more particularly, to a corrugating roll assembly for a single facer.

In the manufacture of corrugated paperboard, a single facer apparatus is used to corrugate the medium web, apply glue to the flute tips on one face thereof, and to bring a liner web into contact with the glued flute tips of the medium web with the application of sufficient heat and pressure to provide an initial bond. A conventional single facer typically includes a pair of fluted corrugating rolls and a pressure roll, which are aligned so the axes of all three rolls are generally coplanar. The medium web is fed between the inter-engaging corrugating rolls and the adhesive is applied to the flute tips by a glue roll while the medium is still on the corrugating roll which comprises the intermediate of the three roll arrangement. The liner web is immediately thereafter brought into contact with the adhesive-coated flute tips in the nip between the pressure roll and the corrugating roll.

As corrugating nip roll pressures and corrugating speeds have increased, changes have been made in the construction of single facers to maintain the quality of the corrugated medium and to attempt to deal with the problems of high noise and vibration. For example, the load between corrugating rolls at the corrugating nip has required that one of the fluted corrugating rolls be made with a crowned surface to accommodate roll deflection under high nip loads. Deflection as a result of high loading is also believed to be one source of noise and vibration. In a conventional single facer construction, where the two corrugating rolls and the lower pressure roll are in general alignment (their axes lying generally coplanar), corrugating roll loads are transmitted to the pressure roll adding further to the problems associated with high loads and high speeds. This has resulted, in some cases, in manufacturing the pressure roll with a negative crown to match deflections in the corrugating roll which together form the nip for joining the two single face web components.

One of the most serious problems in the operation of high speed single facers is the so-called "labyrinth" effect. In order to handle high loads and higher speeds, single facer manufacturers have gone to increasingly larger diameter, heavier and stronger corrugating rolls. As the medium web is drawn into the pressure nip, formed by the inter-engaging flutes on the two corrugating rolls, the medium web begins to be deformed, folded and gathered as it moves into the actual nip centerline where full engagement of the flutes occurs. Larger diameter corrugating rolls inherently create a more tortuous path for the web as the web begins to be wrapped partially around opposite alternating teeth or flutes of the mating corrugating rolls while moving into the fully nipped position. Each wrap of the web encompasses a slightly larger radius around the flute tip as it approaches the nip and each deformation or wrapping of the web on a flute tip adds a tension component to the overall web tension. As indicated, the additive labyrinth effect is increased as the corrugating roll diameters increase and it is not uncommon for the medium web to rupture or tear.

One proposed solution to the labyrinth problem is disclosed in U.S. Pat. No. 3,990,935. The single facer construction disclosed in this patent proposes to maintain relatively small diameter corrugating rolls to minimize the labyrinth length and to provide internally pressurized flexure compensation for the inevitable bowing to which the rolls are subjected under high corrugating nip loads. Another proposed solution to the labyrinth effect is described in U.S. Pat. No. 4,531,996. In accordance with this patent, the upper corrugating roll contact with the lower corrugating roll is "dephased" by dividing the upper roll into axially adjacent segments each of which makes nip contact with the other corrugating roll at a different point. Alternately, the dephasing effect is provided by making the segments of the upper corrugating roll of different diameters. Both of the foregoing solutions require extremely complex roll constructions.

SUMMARY OF THE INVENTION

In accordance with the present invention, the labyrinth effect is minimized in a modified single facer by utilizing an intermediate corrugating roll between two larger diameter conventional corrugating rolls and capturing the intermediate roll in a manner to balance the loadings and minimize roll deflection.

In accordance with the preferred embodiment, a single facer utilizes a pair of conventional fluted main corrugating rolls mounted and operated to impose a corrugating nip force acting normal to the roll axes and generally in the plane common thereto. An intermediate fluted corrugating roll is mounted between and in rotatable engagement with both main corrugating rolls and with its axis lying generally in the same common plane. The intermediate roll forms the: corrugating nip with one of the main corrugating rolls and has a diameter, as compared to the main corrugating rolls, sufficiently small to provide a reduction in the labyrinth paper path sufficient to prevent rupture c,f the medium web. By capturing the intermediate web corrugating roll between the two main corrugating rolls, the nip force acts to hold the smaller intermediate roll against axial bending in the common plane of their axes.

A significant reduction in the labyrinth path of the web is effected by maintaining the ratio of the diameter of the main corrugating roll and the intermediate corrugating roll which together form the nip not less than about 3:1. Preferably, one or both of the main corrugating rolls are heated and the intermediate corrugating roll may be heated as well.

The apparatus is preferably constructed with the corrugated medium wrapped on the intermediate corrugating roll downstream of the corrugating nip to the line of engagement between the intermediate roll and the other main corrugating roll, and then back wrapped on the other main corrugating roll downstream to the point of joinder with the liner web in the pressure nip. Preferably, the intermediate corrugating roll and the other or lower corrugating roll include means for applying a vacuum to the portions of the corrugated medium wrapped thereon. The apparatus may include a pressure roll of any common construction mounted in operative rotational contact with the main corrugating roll carrying the corrugated medium. The pressure roll carries a liner web and forms with the main corrugating roll a pressure nip to join the liner web to the corrugated medium to the flute tips of which a suitable adhesive has been applied.

BRIEF DESCRIPTION OF THE DRAWINGS

FIG. 1 is a schematic side elevation of a single facer incorporating the construction of the present invention.

FIG. 2 is a schematic representation of the labyrinth path in corrugating rolls of the prior art.

FIG. 3 is a schematic representation of the labyrinth path in the corrugating rolls of the present invention.

DETAILED DESCRIPTION OF THE PREFERRED EMBODIMENT

In the single facet apparatus shown in FIG. 1, a conventional upper main corrugating roll 10 and lower main corrugating roll 11 are mounted in a modified position to capture therebetween and operate in rotating interengagement with a small intermediate corrugating roll 12. Each of the rolls 10–12 is provided with a conventional fluted peripheral surface with the flutes of each roll being of the same size, shape and pitch. In accordance with standards in the corrugated paperboard industry, flute configurations vary in terms of pitch dimension (number of flutes per foot) and flute depth (crown to root dimension). In the U.S., the configurations range from A-flute having 33 to 35 flutes per foot and a flute depth of 0.1185 inch (4.7 mm) to E-flute having 90 to 96 flutes per foot and a flute depth of 0.045 inch (1.1 mm). A corresponding pitch dimension range from A-flute to E-flute is about ⅓ inch (approximately 8 mm) to about ⅛ inch (about 3 mm).

For many years, single facers have been made with a single pair of corrugating rolls, such as rolls 10 and 11 which were counterrotated to create a corrugating nip therebetween. A paper medium web 13 is fed directly into the nip and corrugated in the usual manner. Also until relatively recently, the diameters of the inter-engaging corrugated roll pair did not exceed about 12 inches (about 30 cm). However, as corrugator line speeds increased with a concomitant need to increase the speed of the single facer, corrugating roll diameters were increased to as large as 18 inches (about 46 cm) or more.

Referring also to FIGS. 2 and 3, there is shown schematically the generation of the so-called labyrinth path which the medium web 13 follows as it is pulled into the corrugating nip. Each of the FIGS. 2 and 3 illustrations utilizes interengaging corrugating rolls having flutes of the same pitch and shape, the only differences being in the diameter of one corrugating roll in each pair. FIG. 2 shows the medium web moving generally tangentially into the corrugating nip between two equal and relatively large diameter corrugating rolls, such as main rolls 10 and 11 in FIG. 1, if repositioned. As the diameter of a corrugating roll increases, its arc or pitch circle naturally tends to straighten or flatten. As the medium web 13 is drawn into the nip 14, it begins to be gathered and folded by contact with the flutes of both rolls upstream of the nip. Thus, before the web reaches its final corrugated flute shape at the centerline of the nip 14, it has already been subjected, in the illustrated embodiment, to some degree of folding or wrapping around three flute tips in addition to the fully interengaged flute tip pair at the nip. This is what is referred to in the industry as the labyrinth path. The wrapping of the web around each flute tip creates added tension in the web and these tension forces are additive. The forces are calculated in accordance with the function $e^{\mu}\beta$, where $\mu$ is the coefficient of friction and $\beta$ is the angle of wrap around the arcuate flute tip in radians. As corrugating roll diameters have increased to match corrugator speeds and nip loadings, the labyrinth paths have increased to the point where excess tension in the web often results in rupture of the medium web at the nip.

In accordance with the present invention, the interposition of the small diameter corrugating roll 12 between the upper and lower corrugating rolls 10 and 11 has the effect of considerably reducing the labyrinth path length and the corresponding build up of additive web tension. The modified single facer still utilizes larger high speed and high strength corrugating rollers which capture the small diameter intermediate roll 12 therebetween. As shown in FIG. 3, the length of the labyrinth path into the modified corrugating nip 15, formed by inter-engagement of the upper main corrugating roll 10 and the smaller diameter intermediate corrugating roll 12, is substantially reduced in length. As may be seen, the medium web 13 is partially wrapped on only two flute tips (in addition to the fully engaged pair at the nip 15) resulting in a labyrinth length significantly shorter than the length of the labyrinth in the FIG. 2 illustration. It is also believed that as the number of reverse bends imparted to the medium web as it travels through the serpentine labyrinth path increases with corrugating roll diameter increase, the problem of increasing tensile force on the web is compounded.

By maintaining the relatively large diameters of the upper and lower main corrugating rolls 10 and 11, high corrugating speeds and the resistance of the rolls to deflection may be retained. As shown in FIG. 1, the assembly of the three corrugating rolls 10–12 results in their rotational axes lying generally in a common plane. This plane also passes through the corrugating nip 15 and the corresponding nip 16 between the intermediate roll 12 and the lower corrugating roll 11. It should be noted that because the medium web 13 passing through nip 16 has already been corrugated, there is no labyrinth effect in nip 16. With main corrugating rolls 10 and 11 manufactured to larger diameters with inherently improved resistance to axial bending in the common plane, smaller and lower strength intermediate corrugating roll 12 is captured therebetween and held against axial bending or deformation in that plane. It is believed that the three roll assembly of the present invention may even allow the elimination of expensive crowned corrugating roll constructions. It is possible, if desired, to substantially increase the diameter of the upper corrugating roll 10 (and the lower corrugating roll 11 as well) to, for example, 24 inches (in excess of 60 cm). Correspondingly, the smaller intermediate corrugating roll 12 may have a diameter as small as 6 inches (about 15 cm), but may have a diameter of 8 inches (20 cm) or larger. It is believed that a ratio of diameters of upper corrugating roll 10 to intermediate corrugating roll 12 of at least about 3:1 is desirable. This ratio may, however, be varied considerably depending on overall medium web strength and roll speeds. Variation in flute type may also have some effect, but the benefits of labyrinth path length reduction provided by the subject invention are applicable to all flute types.

The remaining construction of the single facer utilizing the subject invention may be generally conventional. Thus, one or all of the corrugating rolls 10, 11 and 12 may be internally heated with steam, as through connections in their respective axial supporting shafts 17,18 and 20, all in a manner well known in the art. Preferably, both the intermediate corrugating roll 12 and the lower main corrugating roll 11 are provided with conventional vacuum systems by which vacuum is applied, via suitable networks of axial and radial vacuum passages 21 and 22, to the corrugated medium 23 wrapped thereon to help maintain its shape and position. The glue roll 24 of a conventional glue applicator makes rotating contact with the flute tips of the corrugated medium 23 on the lower corrugating roll 11. A liner web 26 is carried around a portion of a pressure roll 25 where it is brought into contact with the glued flute tips of the corrugated medium 23 in the pressure nip 27 formed by the pressure roll 25 and the lower corrugating roll 11. The pressure roll 25 may be of a conventional construction and positioned with its axis generally in the same plane as the axes of the corrugating rolls 1012. Alternately, other pressure roll constructions may also be used, including a low pressure nip roll with supplemental curing of the resultant single face web 28 such as in downstream web heating device 30, as disclosed in my co-pending application Ser. No. 08/424,994, entitled "Vacuum Assisted Web Drying System", filed Apr. 19, 1995; or my co-pending application entitled "Pressure Roll for a Single Facer" filed on the same date as this application.

I claim:

1. In a single facer apparatus for producing a single face corrugated web, including a pair of fluted main corrugating rolls rotatable on parallel spaced roll axes with flutes of the same shape and pitch adapted to inter-engage to form a corrugating nip for a paper machine web, means rotatably mounting said main corrugating rolls to impose a corrugating nip force normal to the roll axes generally in the plane common thereto, the improvement comprising:

an intermediate fluted corrugating roll mounted between and in rotatable engagement with said main corrugating rolls and with the axis of said intermediate roll lying generally in said common plane; and, said intermediate roll forming with one main corrugating roll the corrugating nip and having a diameter sufficiently smaller than the diameter of said one main corrugating roll to provide a reduction in the labyrinth paper path sufficient to prevent rupture of the medium web.

2. The apparatus as set forth in claim 1 wherein the main corrugating rolls are heated.

3. The apparatus as set forth in claim 2 wherein the intermediate corrugating roll is heated.

4. The apparatus as set forth in claim 1 wherein the ratio of the diameters of said one main corrugating roll and the intermediate corrugating roll is not less than about 3:1.

5. The apparatus as set forth in claim 1 wherein the corrugated medium is wrapped on the intermediate roll downstream of the corrugating nip to the line of engagement between said intermediate roll and the other main corrugating roll, and backwrapped on said other main corrugating roll downstream of said line of engagement.

6. The apparatus as set forth in claim 5 including means for applying a vacuum to the portions of the intermediate corrugating roll and the other main corrugating roll upon which the corrugated medium is wrapped.

7. The apparatus as set forth in claim 1 comprising a cylindrical pressure roll in operative rotational contact with said other main corrugating roll, said pressure roll carrying a liner web and forming with said main roll a pressure nip for joining the liner web to the corrugated medium carried on said main roll.

* * * * *